US011814607B2

(12) United States Patent
Crossman et al.

(10) Patent No.: US 11,814,607 B2
(45) Date of Patent: Nov. 14, 2023

(54) LAUNDRY ADDITIVE COMPOSITION COMPRISING A SOIL RELEASE POLYMER/SILICONE MIXTURE

(71) Applicant: Conopco, Inc., Englewood Cliffs, NJ (US)

(72) Inventors: Martin Charles Crossman, Wirral (GB); Jonathan Osler, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 217 days.

(21) Appl. No.: 16/971,182

(22) PCT Filed: Feb. 19, 2019

(86) PCT No.: PCT/EP2019/054108
§ 371 (c)(1),
(2) Date: Aug. 19, 2020

(87) PCT Pub. No.: WO2019/166283
PCT Pub. Date: Sep. 6, 2019

(65) Prior Publication Data

US 2021/0115356 A1 Apr. 22, 2021

(30) Foreign Application Priority Data

Mar. 2, 2018 (EP) ..... 18159799

(51) Int. Cl.

| | |
|---|---|
| ***C11D 9/36*** | (2006.01) |
| ***C11D 3/00*** | (2006.01) |
| ***C11D 3/37*** | (2006.01) |
| ***C11D 3/50*** | (2006.01) |
| ***C11D 11/00*** | (2006.01) |
| ***C11D 17/00*** | (2006.01) |

(52) U.S. Cl.
CPC ..... *C11D 3/0015* (2013.01); *C11D 3/373* (2013.01); *C11D 3/3715* (2013.01); *C11D 3/50* (2013.01); *C11D 11/0017* (2013.01); *C11D 17/0008* (2013.01)

(58) Field of Classification Search
CPC ... C11D 11/0017; C11D 3/373; C11D 3/3742; C11D 1/02; C11D 1/66; C11D 3/50; C11D 3/0015; C11D 17/0008; C11D 3/3715; C11D 9/36; C11D 17/0021
See application file for complete search history.

(56) References Cited

U.S. PATENT DOCUMENTS

| | | | | |
|---|---|---|---|---|
| 3,893,929 | A | 7/1975 | Basadur | |
| 3,959,230 | A | 5/1976 | Hays | |
| 4,661,267 | A | 4/1987 | Dekker | |
| 4,711,730 | A | 8/1987 | Gosselink et al. | |
| 4,702,857 | A | 10/1987 | Gosselink et al. | |
| 4,721,580 | A | 1/1988 | Gosselink | |
| 4,877,896 | A | 10/1989 | Maldonado et al. | |
| 4,968,451 | A | 6/1990 | Scheibel et al. | |
| 8,038,729 | B2 | 10/2011 | Hodge et al. | |
| 9,150,993 | B2 | 6/2015 | Bennett et al. | |
| 11,180,721 | B2 * | 11/2021 | Crossman | C11D 3/505 |
| 2002/0111285 | A1 * | 8/2002 | Price | C11D 11/0017 510/276 |
| 2003/0060390 | A1 * | 3/2003 | Demeyere | C11D 3/001 510/330 |
| 2006/0030513 | A1 | 2/2006 | Binder et al. | |
| 2009/0239781 | A1 | 9/2009 | Smalley et al. | |
| 2010/0132126 | A1 | 6/2010 | Itou et al. | |
| 2013/0123160 | A1 | 5/2013 | Dobrawa et al. | |
| 2013/0200290 | A1 | 8/2013 | Morschhaeuser et al. | |
| 2016/0060571 | A1 | 3/2016 | Panandiker et al. | |
| 2016/0060574 | A1 | 3/2016 | Panandiker et al. | |
| 2016/0319227 | A1 | 11/2016 | Lant et al. | |
| 2016/0355763 | A1 | 12/2016 | Somerville-Roberts et al. | |
| 2017/0335245 | A1 | 11/2017 | Burgess et al. | |

FOREIGN PATENT DOCUMENTS

| | | |
|---|---|---|
| CN | 1224447 | 7/1999 |
| CN | 101535559 | 9/2009 |
| CN | 101679912 | 3/2010 |
| CN | 101680158 | 3/2010 |
| CN | 101978039 | 2/2011 |
| CN | 102171323 | 8/2011 |
| CN | 102575203 | 7/2012 |
| CN | 104781381 | 7/2015 |
| CN | 107075422 | 8/2017 |

(Continued)

OTHER PUBLICATIONS

Search Report and Written Opinioin in EP18159799.
Search Report and Written Opinion in EP18159798; dated Aug. 21, 2018; World Intellectual Property Org. (WIPO).
Search Report and Written Opinion in EP18159807; dated Aug. 21, 2018; European Patent Office (EPO).
Search Report and Written Opinion in EP18159783.
Search Report and Written Opinion of PCTEP2019054831; dated May 6, 2019.
Search Report and Written Opinion in PCTEP2019054832; dated May 6, 2019; World Intellectual Property Org. (WIPO).
Search Report and Written Opnion in PCTEP2019054076; dated May 23, 2019.

(Continued)

*Primary Examiner* — Charles I Boyer
(74) *Attorney, Agent, or Firm* — Carter, DeLuca & Farrell LLP; George Likourezos; Bret P. Shapiro

(57) ABSTRACT

Method for softening knitted cotton, wherein knitted cotton is treated with an ancillary laundry composition comprising: a. Soil release polymer b. Silicone c. less than 4 w.t. % surfactant; and d. Water wherein the method comprises delivering the ancillary laundry composition into the wash or rise stage and comprises the steps of: a. Pouring a laundry product into a washing receptacle, a washing machine drawer, or a dosing shuttle b. Pouring the ancillary laundry composition on top of the laundry product. Use of the method for softening knitted cotton.

10 Claims, No Drawings

(56) References Cited

FOREIGN PATENT DOCUMENTS

| | | |
|---|---|---|
| EP | 2135931 | 12/2009 |
| EP | 2987848 | 2/2016 |
| WO | WO9742286 | 11/1997 |
| WO | WO9909133 | 2/1999 |
| WO | WO2008154633 | 12/2008 |
| WO | WO2011047951 | 4/2011 |
| WO | WO2014079621 | 5/2014 |
| WO | WO2015078692 | 6/2015 |
| WO | WO2015078764 | 6/2015 |
| WO | WO2015078766 | 6/2015 |
| WO | WO2016066368 | 6/2016 |
| WO | WO2018059892 | 4/2018 |

OTHER PUBLICATIONS

Search Report and Written Opinion for PCTEP2019054108; dated Sep. 5, 2019.
Written Opinion in PCTEP2019054832; dated Feb. 4, 2020.
IPRP2 in PCTEP2019054108.
IPRP2 in PCTEP2019054076.
IPRP2 in PCTEP2020054832; dated Jun. 17, 2020.

* cited by examiner

LAUNDRY ADDITIVE COMPOSITION COMPRISING A SOIL RELEASE POLYMER/SILICONE MIXTURE

FIELD OF THE INVENTION

The present invention relates to an ancillary laundry composition providing improved softening to fabrics. In particular an ancillary laundry composition providing softening to knitted cotton.

BACKGROUND OF THE INVENTION

Textile fabrics, including clothes can often feel harsh after the laundry process. To reduce the harshness experienced after multiple wash cycles, consumers seek care benefits from their laundry products. This is a particular issue for knitted cotton fabrics. Knitted cotton is a particularly soft fabric and maintaining this softness is a priority for many consumers.

There is a need to improve the softening performance provided by the fabric treatment compositions. The compositions of the present invention provide an ancillary laundry composition with enhanced softening of knitted cotton.

SUMMARY OF THE INVENTION

In a first aspect of the present invention, there is provided a method for softening knitted cotton, wherein knitted cotton is treated with an ancillary laundry composition comprising:

a. Soil release polymer
b. Silicone
c. less than 4 w.t. % surfactant; and
d. Water wherein the method comprises delivering the ancillary laundry composition into the wash or rise stage and comprises the steps of:

a. Pouring a laundry product into a washing receptacle, a washing machine drawer, or a dosing shuttle
b. Pouring the ancillary laundry composition on top of the laundry product.

In a second aspect of the present invention, there is provided a use of the method according to the invention for softening knitted cotton.

It is known that soil release polymers do not deposit on cotton material, however surprisingly a synergy has been found to exist between soil release polymers and silicone polymers which leads to improved softening of knitted cotton.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

Form of the Invention

The term 'ancillary laundry composition' is used to refer to a specific format of laundry product. This is a liquid product which is used in addition to a laundry detergent and/or the fabric conditioner to provide an additional or improved benefit to the materials in the wash or rinse cycle. This is a low surfactant product. Ancillary laundry compositions may also be referred to as a serum.

Soil Release Polymer

Suitable soil release polymers can be synthesised by conventional techniques well-known the skilled person, such as those described in US 2013/0200290.

Soil release polymers may be present at a level selected from: less than 30%, less than 20%, and less than 15%, by weight of the laundry composition. Soil release polymers may be present at a level selected from: more than 1%, more than 1.5%, and more than 2.5%, by weight of the composition. Suitably Soil release polymers is present in the composition in an amount selected from the range of from about 1% to about 30%, preferably from about 1.5% to about 20%, more preferably from about 2.5% to about 15%, by weight of the composition.

The soil release polymer has one or more fabric-binding regions, to provide fabric substantively. For example, the soil release polymer may include a fabric-binding region capped by one or more hydrophilic regions. Typically, the fabric-binding region forms the central portion of the molecule (the "midblock") and is capped by hydrophilic groups. The anionic substituents are provided on the fabric-binding region and/or on the end cap, since these disrupt surfactant interaction with the soil release polymer.

The weight average molecular weight of the polymeric soil release polymer may be at least 1,000, at least 2,000, at least 5,000, at least 10,000, at least 15,000, at least 20,000 or at least 25,000. The upper limit for the weight average molecular weight may be, for example, 100,000; 75,000; 60,000; 55,000; 50,000; 40,000 or 30,000. For example, the weight average molecular weight may be between about 5,000 to about 50,000, such as between about 1,200 to 12,000.

Preferably the soil release polymers of the present invention are polymers according to the following generic formula:

$$X_1—R_1—Z—R_2—X_2 \qquad \text{Formula (I)}$$

Wherein:

$X_1$ and $X_2$ are independently capping moieties $R_1$ and $R_1$ are independently one or more nonionic hydrophilic blocks Z is one or more anionic hydrophobic blocks $X_1$ and $X_2$ are independently, preferably, alkyl groups, more preferably $C_{1-4}$ alkyl branched or unbranched moieties.

$R_1$ and $R_1$ are independently, preferably blocks consisting of one or more nonionic hydrophilic components selected from:

(i) polyoxyethylene segments with a degree of polymerization of at least 2, preferably from 3 to about 150, more preferably from 6 to about 100 or (ii) polyoxypropylene segments with a degree of polymerization of at least 2, or (iii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iv) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (v) oxypropylene and/or polyoxypropylene segments in the terminal positions of the polymer chain.

Z preferably consists of one or more anionic hydrophobic components selected from:

(i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, where the terephthalate segments are at least partially sulphonated (ii) $C_4$-$C_6$ alkylene or oxy $C_4$-$C_6$ alkylene segments, or mixtures therein, preferably these segments include, but are not limited to, end-caps of polymeric soil release agents such as MO3 S(CH2)n OCH2 CH2 O—, where M is sodium and n is an integer from 4-6, as disclosed in U.S. Pat. No. 4,721,580, issued Jan. 26, 1988 to Gosselink.

(iii) poly (vinyl ester) segments, preferably polyvinyl acetate), having a degree of polymerization of at least 2, or (iv) C1-C4 alkyl ether or C4 hydroxyalkyl ether substituents, or mixtures therein, wherein said substituents are present in the form of C1-C4 alkyl ether or C4 hydroxyalkyl ether cellulose derivatives, or mixtures therein, and such cellulose derivatives are amphiphilic, whereby they have a sufficient level of C1-C4 alkyl ether and/or C4 hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b). preferably these segments include graft copolymers of poly(vinyl ester), e.g., C1-C6 vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

(iv) isophthalate groups, such as a 1, 4-phenylene moiety or a 1, 3-phenylene moiety having 0 to 4 anionic substituents (such as carboxylate, phosphonate, phosphate or, preferably sulphonate), preferably 1, 4-phenylene moiety having 0 to 4 anionic substituents.

Preferably, the Z is a polyester polymer or comprises a polyester copolymer region.

In one preferred example, the soil release polymer may be according to the following formula (II)

Formula (II)

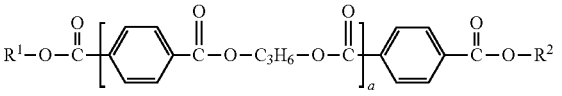

wherein $R^1$ and $R^2$ independently of one another are $X—(OC_2H_4)_n—(OC_3H_6)_m$ wherein X is $C_{1-4}$ alkyl, the $—(OC_2H_4)$ groups and the $—(OC_3H_6)$ groups are arranged blockwise and the block consisting of the $—(OC_3H_6)$ groups is bound to a COO group or are $HO—(C_3H_6)$, n is based on a molar average a number of from 12 to 120 and preferably of from 40 to 50, m is based on a molar average a number of from 1 to 10, and a is based on a molar average a number of from 4 to 9 and In the polymer of formula (I), "X" of $R^1$ and $R^2$ is preferably methyl.

In the polymer of formula (I), the $—(OC_3H_6)$ groups of $R^1$ and $R^2$ is preferably bound to a COO group.

In the polymer of formula (I), the variable "n" based on a molar average preferably is a number of from 40 to 50, more preferably is a number of from 43 to 47 and even more preferably is 44 to 46 and most preferably 45.

In the polymer of formula (I), the variable "m" based on a molar average preferably is a number of from 1 to 7, more preferably a number from 2 to 6.

In the polymer of formula (I), the variable "a" based on a molar average preferably is a number of from 5 to 8 and more preferably is a number of from 6 to 7.

The groups $—O—C_2H_4—$ in the structural units "$X—(OC_2H_4)_n—(OC_3H_6)_m$" or "$H_3C—(OC_2H_4)_n—(OC_3H_6)_m$," are of the formula $—O—CH_2—CH_2—$.

The groups $—O—C_3H_6—$ in the structural units indexed with "a", in the structural units "$X—(OC_2H_4)_n—(OC_3H_6)_m$" or "$H_3C—(OC_2H_4)_n—(OC_3H_6)_m$" and in the structural units $HO—(C_3H_6)$ are of the formula $—O—CH(CH_3)—CH_2—$ or $—O—CH_2—CH(CH_3)—$, i.e. are of the formula

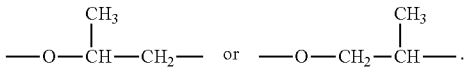

In one particularly preferred embodiment of the invention the polyesters of component A) of the inventive compositions are according to the following formula (I)

$R^1$ and $R^2$ independently of one another are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average a number of from 44 to 46, m is based on a molar average 2, and a is based on a molar average a number of from 5 to 8.

And more preferably:

$R^1$ and $R^2$ independently of one another are $H_3C—(OC_2H_4)_n—(OC_3H_6)_m$ wherein the $—(OC_2H_4)$ groups and the —$(OC_3H_6)$ groups are arranged blockwise and the block consisting of the —$(OC_3H_6)$ groups is bound to a COO group, n is based on a molar average 45, m is based on a molar average 2, and a is based on a molar average a number of from 6 to 7 are especially preferred.

In an alternate particularly preferred embodiment of the invention the polyesters of component A) of the inventive compositions are according to the following formula (I)

$R^1$ and $R^2$ independently of one another are $H_3C$—$(OC_2H_4)_n$—$(OC_3H_6)_m$ wherein the —$(OC_2H_4)$ groups and the —$(OC_3H_6)$ groups are arranged blockwise and the block consisting of the —$(OC_3H_6)$ groups is bound to a COO group, n is based on a molar average a number of from 44 to 46, m is based on a molar average 5, and a is based on a molar average a number of from 5 to 8.

And more preferably:

$R^1$ and $R^2$ independently of one another are $H_3C$—$(OC_2H_4)_n$—$(OC_3H_6)_m$ wherein the —$(OC_2H_4)$ groups and the —$(OC_3H_6)$ groups are arranged blockwise and the block consisting of the —$(OC_3H_6)$ groups is bound to a COO group, n is based on a molar average 45, m is based on a molar average 5, and a is based on a molar average a number of from 6 to 7 are especially preferred.

In an alternative preferred example, the soil release polymers comprise copolymers having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Preferred polymeric soil release polymers also include the soil release agents of U.S. Pat. No. 4,877,896, issued Oct. 31, 1989 to Maldonado et al, which discloses anionic, especially sulfoarolyl, end-capped terephthalate esters.

In an alternative preferred example, the soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

In an alternative preferred example, the soil release polymers comprise polymers of aromatic dicarboxylic acids and alkylene glycols (including polymers containing polyalkylene glycols). For example, the soil release polymer may comprise a fabric-binding region formed from aromatic dicarboxylic acid/ester monomer units. Most preferably, the anionic soil release polymer is formed from aromatic dicarboxylic acid/ester and alkylene glycol units (including polymers containing polyalkylene glycols), such as those described in US 2013/0200290. Examples of suitable polymers include Texcare® SRA 100N or Texcare® SRA 300F marketed by Clariant®.

In a more preferred example, the soil release polymer may be according to the following formula (III):

$$X—[(EO)_{q1}\text{-block-}(PO)_p]—[(A—G_1—A—G_2)n]—B—G_1—B—[(PO)_p\text{-block-}(EO)_{q2}]—X \quad \text{Formula (III)}$$

In an alternative preferred example, the soil release polymer is a polyester with repeat units of ethylene terephthalate units contains 10-15% by weight of ethylene terephthalate units together with 90-80% by weight of polyoxyethylene terephthalate units, derived from a polyoxyethylene glycol of average molecular weight 300-5,000. Examples of this polymer include the commercially available material ZELCON 5126 (from DuPont) and MILEASE T (from ICI). See also U.S. Pat. No. 4,702,857, issued Oct. 27, 1987 to Gosselink. Further examples of soil release polymers are terephthalic acid/glycol copolymers sold under the tradenames Texcare®, Repel-o-Tex®, Gerol®, Marloquest® and, Cirrasol®.

In an alternative preferred example, the soil release polymer is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

wherein EO is ethylene oxide (CH2CH2O) and PO is at least 80 wt % propylene oxide (CH2CH(CH3)O), and preferably 100% PO units;

where p is a number from 0 to 60, and when p is not zero is preferably from 2 to 50, more preferably from 5 to 45, even more preferably from 6 to 40, yet more preferably from 7 to 40 and most preferably from 8 to 40, even from 11 to 35;

where q1 and q2 is a number from 6 to 120, preferably 18 to 80, most preferably 40 to 70, provided that q2 is greater than p and preferably q2 is at least 1.5 times as large as p;

where n is a number from 2 to 26; preferably 5 to 15;

Because they are an average, n, p, q1 and q2 are not necessarily a whole number for the polymer in bulk.

where X is a capping moiety, preferably selected from C1-4 alkyl, branched and unbranched;

A and B are selected from ester, amide and urethane moieties, preferably the moieties A and B nearest to any PO blocks are esters, A and B may be different or may be the same;

when the moieties A and B adjacent to the PO blocks are esters then it is preferred that p is not zero, alternatively, it is preferred that the ratio of (q1+q2):n is from 4 to 10 and that q2 is from 40 to 120;

G1 comprises 1,4 phenylene;

G2 is ethylene, which may be substituted;

It is preferred that moieties G2 are all ethylene of formula (IV)

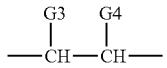

(IV)

wherein G3 and G4 are selected from Hydrogen, C1-4 alkyl and C1-4 alkoxy, provided that at least one of G3 and G4 is not hydrogen and that at least 10% of the groups G2 have neither G3 nor G4 as hydrogen. Preferably when G3 and G4 are not hydrogen then they are methyl moieties. Preferably the non H substituents, more preferably the methyl moieties, are arranged in syn configuration on the ethylene backbone —CH—CH— of moieties G2.

Silicone

The compositions of the present invention comprise silicone.

Silicone may be present at an amount selected from: less than 60%, less than 30%, and less than 20%, by weight of the ancillary composition. Silicone may be present at an amount selected from: more than 1%, more than 2%, and more than 3%, by weight of the composition. Suitably silicone is present in the composition in an amount selected from the range of from about 1% to about 60%, preferably from about 2% to about 30%, more preferably from about 3% to about 20%, by weight of the composition.

Silicones and their chemistry are described in, for example in The Encyclopaedia of Polymer Science, volume 11, p 765.

Silicones suitable for the present invention are fabric softening silicones. Non-limiting examples of such silicones include:

Non-functionalised silicones such as polydimethylsiloxane (PDMS),

Functionalised silicones such as alkyl (or alkoxy) functionalised, alkylene oxide functionalised, amino functionalised, phenyl functionalised, hydroxy functionalised, polyether functionalised, acrylate functionalised, siliconhydride functionalised, carboxy functionalised, phosphate functionalised, sulphate functionalised, phosphonate functionalised, sulphonic functionalised, betaine functionalised, quarternized nitrogen functionalised and mixtures thereof.

Copolymers, graft co-polymers and block co-polymers with one or more different types of functional groups such as alkyl, alkylene oxide, amino, phenyl, hydroxy, polyether, acrylate, siliconhydride, carboxy, phosphate, sulphonic, phosphonate, betaine, quarternized nitrogen and mixtures thereof.

Suitable non-functionalised silicones have the general formula:

R1-Si(R3)2-O—[—Si(R3)2-O-]x-Si(R3)2-R2

R1=hydrogen, methyl, methoxy, ethoxy, hydroxy, propoxy, and aryloxy group.

R2=hydrogen, methyl, methoxy, ethoxy, hydroxy, propoxy, and aryloxy group.

R3=alkyl, aryl, hydroxy, or hydroxyalkyl group, and mixtures thereof

Suitable functionalised silicones may be anionic, cationic, or non-ionic functionalised silicones.

The functional group(s) on the functionalised silicones are preferably located in pendent positions on the silicone i.e. the composition comprises functionalised silicones wherein the functional group(s) are located in a position other than at the end of the silicone chain. The terms 'terminal position' and 'at the end of the silicone chain' are used to indicate the terminus of the silicone chain.

When the silicones are linear in nature, there are two ends to the silicone chain. In this case the anionic silicone preferably contains no functional groups located on a terminal position of the silicone.

When the silicones are branched in nature, the terminal position is deemed to be the two ends of the longest linear silicone chain. Preferably no functional group(s) are located on the terminus of the longest linear silicone chain.

Preferred functionalised silicones are those that comprise the anionic group at a mid-chain position on the silicone. Preferably the functional group(s) of the functionalised silicone are located at least five Si atoms from a terminal position on the silicone. Preferably the functional groups are distributed randomly along the silicone chain. For best performance, it is preferred that the silicone is selected from: anionic functionalised silicone, non-functionalised silicone; and mixtures thereof. More preferably, the silicone is selected from: carboxy functionalised silicone; amino functionalised silicone; polydimethylsiloxane (PDMS) and mixtures thereof. Preferred features of each of these materials are outlined herein.

A carboxy functionalised silicone may be present as a carboxylic acid or an carbonate anion and preferably has a carboxy group content of at least 1 mol % by weight of the silicone polymer, preferably at least 2 mol %. Preferably the carboxy group(s) are located in a pendent position, more preferably located at least five Si atoms from a terminal position on the silicone. Preferably the caboxy groups are distributed randomly along the silicone chain. Examples of suitable carboxy functional silicones include FC 220 ex. Wacker Chemie and X22-3701E ex. Shin Etsu.

An amino functionalised silicone means a silicone containing at least one primary, secondary or tertiary amine group, or a quaternary ammonium group. The primary, secondary, tertiary and/or quaternary amine groups are preferably located in a pendent position, more preferably located at least five Si atoms from a terminal position on the silicone. Preferably the amino groups are distributed randomly along the silicone chain. Examples of suitable amino functional silicones include FC222 ex. Wacker Chemie and EC218 ex. Wacker Chemie.

A polydimethylsiloxane (PDMS) polymer has the general formula:

R1-Si(CH3)2-O—[—Si(CH3)2-O-]x-Si(CH3)2-R2

R1=hydrogen, methyl, methoxy, ethoxy, hydroxy, propoxy, and aryloxy group.

R2=hydrogen, methyl, methoxy, ethoxy, hydroxy, propoxy, and aryloxy group.

A suitable example of a PDMS polymer is E22 ex. Wacker Chemie.

Most preferably the silicone is PDMS, amino functionalised silicone or mixtures thereof as described above.

The molecular weight of the silicone polymer is preferably from 1,000 to 500,000, more preferably from 2,000 to 250,000 even more preferably from 5,000 to 200,000.

The silicone of the present invention is preferably present in the form of an emulsion. Silicones are preferably emulsified prior to addition to the present compositions. Silicone compositions are generally supplied from manufacturers in the form of emulsions.

The average particle size of the emulsion is in the range from about 1 nm to 150 nm, preferably 1 nm to 100 nm. This may be referred to as a micro emulsion. The particle size is measured as a volume mean diameter, D[4,3], this can be measured using a Malvern Mastersizer 2000 from Malvern instruments.

Ratios of Soil Release Polymer and Silicone

Preferably the levels of soil release polymer and silicone are proportional to each other. A preferred ratio of soil release polymer to silicone is in the range of 10:1 to 1:10, more preferably 5:2 to 1:4.

Surfactants

The liquid ancillary composition of the present invention is not a traditional laundry detergent or fabric conditioning composition. The present invention preferably comprises low levels or no surfactants. Any surfactant present is preferably for the purpose of emulsifying and not for detergency or softening.

The liquid ancillary composition of the present invention comprises less than 4 w.t. % surfactant, preferably less than 2 w.t. % surfactant, more preferably less than 1 w.t.% surfactant, even more preferably less than 0.85 w.t. % surfactant and most preferably less than 0.5 w.t.%. The composition can be completely free of non-emulsified surfactant (ie surfactant not-used to emulsify the droplet).

In other words, the compositions may comprise 0 to 4 w.t. % surfactant, preferably, the composition of the present invention comprises 0 to 2 w.t. % surfactant, more preferably, 0 to 1 w.t. % surfactant, even more preferably 0 to 0.85 w.t. % and most preferably 0 to 0.5 w.t. %. The composition can be completely free of non-emulsified surfactant (ie surfactant not-used to emulsify the droplet).

The term surfactant covers all categories of surfactant, including: anionic, cationic, non-ionic and zwitterion surfactants. Many surfactants are traditionally used in laundry compositions: laundry detergent compositions often comprise anionic and non-ionic surfactants whereas fabric conditioning compositions often comprise cationic surfactants.

The composition of the present invention is not a traditional laundry detergent or fabric conditioning composition. The present invention preferably comprises low levels or no surfactants. Any surfactant present is preferably for the purpose of emulsifying the silicone ant not for detergency or softening.

Perfumes

The laundry compositions of the present invention may preferably comprise 0.1 to 15 w.t. % free perfume, more preferably 0.5 to 8 w.t. % free perfume.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

Particularly preferred perfume components are blooming perfume components and substantive perfume components. Blooming perfume components are defined by a boiling point less than 250° C. and a Log P or greater than 2.5. Substantive perfume components are defined by a boiling point greater than 250° C. and a Log P greater than 2.5. Boiling point is measured at standard pressure (760 mm Hg). Preferably a perfume composition will comprise a mixture of blooming and substantive perfume components. The perfume composition may comprise other perfume components.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume components may be applied.

Cationic Polymer

The laundry composition of the present invention may comprise a cationic polymer. This refers to polymers having an overall positive charge.

The cationic polymer may be naturally derived or synthetic. Examples of suitable cationic polymers include: acrylate polymers, cationic amino resins, cationic urea resins, and cationic polysaccharides, including: cationic celluloses, cationic guars and cationic starches.

The cationic polymer of the present invention may be categorised as a polysaccharide-based cationic polymer or non-polysaccharide based cationic polymers.

Polysaccharide-based cationic polymers:

Polysacchride based cationic polymers include cationic celluloses, cationic guars and cationic starches. Polysaccharides are polymers made up from monosaccharide monomers joined together by glycosidic bonds.

The cationic polysaccharide-based polymers present in the compositions of the invention have a modified polysaccharide backbone, modified in that additional chemical groups have been reacted with some of the free hydroxyl groups of the polysaccharide backbone to give an overall positive charge to the modified cellulosic monomer unit.

A preferred polysaccharide polymer is cationic cellulose. This refers to polymers having a cellulose backbone and an overall positive charge.

Cellulose is a polysaccharide with glucose as its monomer, specifically it is a straight chain polymer of D-glucopyranose units linked via beta-1,4 glycosidic bonds and is a linear, non-branched polymer.

The cationic cellulose-based polymers of the present invention have a modified cellulose backbone, modified in that additional chemical groups have been reacted with some of the free hydroxyl groups of the polysaccharide backbone to give an overall positive charge to the modified cellulose monomer unit.

A preferred class of cationic cellulose polymers suitable for this invention are those that have a cellulose backbone modified to incorporate a quaternary ammonium salt. Preferably the quaternary ammonium salt is linked to the cellulose backbone by a hydroxyethyl or hydroxypropyl group. Preferably the charged nitrogen of the quaternary ammonium salt has one or more alkyl group substituents.

Example cationic cellulose polymers are salts of hydroxyethyl cellulose reacted with trimethyl ammonium substituted epoxide, referred to in the field under the International Nomenclature for Cosmetic Ingredients as Polyquaternium 10 and is commercially available from the Amerchol Corporation, a subsidiary of The Dow Chemical Company, marketed as the Polymer LR, JR, and KG series of polymers. Other suitable types of cationic celluloses include the polymeric quaternary ammonium salts of hydroxyethyl cellulose reacted with lauryl dimethyl ammonium-substituted epoxide referred to in the field under the International Nomenclature for Cosmetic Ingredients as Polyquaternium 24. These materials are available from Amerchol Corporation marketed as Polymer LM-200.

Typical examples of preferred cationic cellulosic polymers include cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethyl ammonio) propyl ether salt, polyquaternium-4, polyquaternium-10, polyquaternium-24 and polyquaternium-67 or mixtures thereof.

More preferably the cationic cellulosic polymer is a quaternised hydroxy ether cellulose cationic polymer. These are commonly known as polyquaternium-10. Suitable commercial cationic cellulosic polymer products for use according to the present invention are marketed by the Amerchol Corporation under the trade name UCARE.

The counterion of the cationic polymer is freely chosen from the halides: chloride, bromide, and iodide; or from hydroxide, phosphate, sulphate, hydrosulphate, ethyl sulphate, methyl sulphate, formate, and acetate.

Non polysaccharide-based cationic polymers:

A non-polysaccharide-based cationic polymer is comprised of structural units, these structural units may be non-ionic, cationic, anionic or mixtures thereof. The polymer may comprise non-cationic structural units, but the polymer must have a net cationic charge.

The cationic polymer may consists of only one type of structural unit, i.e., the polymer is a homopolymer. The cationic polymer may consists of two types of structural units, i.e., the polymer is a copolymer. The cationic polymer may consists of three types of structural units, i.e., the polymer is a terpolymer. The cationic polymer may comprises two or more types of structural units. The structural units may be described as first structural units, second structural units, third structural units, etc. The structural units, or monomers, may be incorporated in the cationic polymer in a random format or in a block format.

The cationic polymer may comprise a nonionic structural units derived from monomers selected from: (meth)acrylamide, vinyl formamide, N, N-dialkyl acrylamide, N, N-dialkylmethacrylamide, C1-C12 alkyl acrylate, C1-C12 hydroxyalkyl acrylate, polyalkylene glyol acrylate, C1-C12 alkyl methacrylate, C1-C12 hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

The cationic polymer may comprise a cationic structural units derived from monomers selected from: N, N-dialkylaminoalkyl methacrylate, N, N-dialkylaminoalkyl acrylate, N, N-dialkylaminoalkyl acrylamide, N, N-dialkylaminoalkylmethacrylamide, methacylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof.

Preferably, the cationic monomer is selected from: diallyl dimethyl ammonium salts (DADMAS), N, N-dimethyl aminoethyl acrylate, N,N-dimethyl aminoethyl methacrylate (DMAM), [2-(methacryloylamino)ethyl]trl-methylammonium salts, N, N-dimethylaminopropyl acrylamide (DMAPA), N, N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof.

The cationic polymer may comprise anionic structural units derived from monomers selected from: acrylic acid (AA), methacrylic acid, maleic acid, vinyl sulfonic acid, styrene sulfonic acid, acrylamidopropylmethane sulfonic acid (AMPS) and their salts, and mixtures thereof.

Some cationic polymers disclosed herein will require stabilisers i.e. materials which will exhibit a yield stress in the ancillary laundry composition of the present invention. Such stabilisers may be selected from: thread like structuring systems for example hydrogenated castor oil or trihydroxystearin e.g. Thixcin ex. Elementis Specialties, crosslinked polyacrylic acid for example Carbopol ex. Lubrizol and gums for example carrageenan.

Preferably the cationic polymer is selected from; cationic polysaccharides and acrylate polymers. More preferably the cationic polymer is a cationic acrylate polymer or a cationic cellulose.

The molecular weight of the cationic polymer is preferably greater than 20 000 g/mol, more preferably greater than 25 000 g/mol. The molecular weight is preferably less than 2 000 000 g/mol, more preferably less than 1 000 000 g/mol.

Cationic polymer may be present at a level selected from: less than 30%, less than 24%, less than 20% and less than 15%, by weight of the laundry composition. Cationic polymer may be present at a level selected from: more than 0.25%, more than 0.4%, more than 0.45 and more than 0.5%, by weight of the composition. Suitably cationic polymer is present in the composition in an amount selected from the range of from about 0.25% to about 30%, preferably from about 0.4% to about 24%, more preferably from about 0.45% to about 20%, most preferably, 0.5 to 15% by weight of the composition.

Ratio of Functionalised Silicone: Cationic Cellulose

In the present invention, when a cationic polymer is present, the ratio of the functionalised fabric softening silicone to cationic cellulose polymer is preferably 10:1 to 1:10, more preferably 5:1 to 1:6, still more preferably 5:2 to 1:6, even more preferably 5:2 to 1:5 and most preferably 2:1 to 1:5.

Rheology Modifier

In some embodiments of the present invention, the liquid ancillary compositions of the present invention may comprise rheology modifiers. These may be inorganic or organic, polymeric or non polymeric. A preferred type of rheology modifiers are salts.

Other Ingredients

The products of the invention may contain pearlisers and/or opacifiers. It may further comprise other optional laundry ingredients.

Physical Characteristics

Preferably the viscosity of the laundry serum composition is greater than the viscosity of a laundry liquid with which it is used, more preferably 300 Pa·s, most preferably 500 Pa·s greater than a laundry liquid with which it is used. The higher viscosity prevents mixing of the laundry serum composition and laundry liquid and provides the benefit that the entire serum composition is carried into the wash or rinse with the laundry liquid.

The viscosity of the laundry composition is preferably 400-15000 Pa·s. This viscosity provides the benefit the laundry liquid carries the serum into the laundry process. Throughout this specification viscosity measurements were carried out at 25° C., using a 4 cm diameter 2° cone and plate geometry on a DHR-2 rheometer ex. TA instruments.

In detail, all measurements were conducted using a TA-Instruments DHR-2 rheometer with a 4 cm diameter 2 degree angle cone and plate measuring system. The lower Peltier plate was used to control the temperature of the measurement to 25° C. The measurement protocol was a 'flow curve' where the applied shear stress is varied logarithmically from 0.01 Pa to 400 Pa with 10 measurement points per decade of stress. At each stress the shear strain rate is measured over the last 5 seconds of the 10 second period over which the stress is applied with the viscosity at that stress being calculated as the quotient of the shear stress and shear rate.

For those systems which exhibit a low shear viscosity plateau over large shear stress ranges, to at least 1 Pa, the characteristic viscosity is taken as being the viscosity at a shear stress of 0.3 Pa. For those systems where the viscosity response is shear thinning from low shear stress the characteristic viscosity is taken as being the viscosity at a shear rate of 21 s-1.

Preferably, the serum floats on a, laundry liquid with which it is used. By float it is meant that the serum will remain at the surface of the laundry liquid for a period of at least 5 minutes, preferably 10 minutes and most preferably at least 15 minutes. Floating provides the benefit the laundry liquid carries the serum into the laundry process.

To enable the serum to float, it is not essential that it is less dense than the laundry liquid with which it is being used, however it is preferred that the serum is less dense than the laundry liquid with which it is used. This density provides the benefit the laundry liquid carries the serum into the laundry process.

The laundry serum composition is preferably not miscible with a laundry liquid with which it is used. The in-admissibility prevents mixing of the laundry serum composition and laundry liquid and ensures maximum performance of the serum.

Method of Use

The compositions of the present invention may be used in a method for softening knitted cotton. Softening may be described as fabric care or fibre care.

Preferably the knitted cotton is treated with the composition during the wash process.

In one preferred aspect of the present invention is a method of delivering the ancillary laundry composition into the wash or rinse stage.

The method of delivering an ancillary laundry composition into the wash or rinse stage, comprises the steps of:

a. Pouring a laundry product into a washing receptacle, a washing machine drawer, or a dosing shuttle
b. Pouring a laundry serum composition according to any preceding claim on top of the laundry product.

By washing receptacle, it is meant any vessel in which washing is performed. This may be for example the drum of a front or top loading washing machine or a bowl/sink in which hand washing is performed. By drawer it as meant any one of the compartments in the washing machine drawer. By dosing ball is meant any form of container which would usually hold a laundry detergent composition and be placed directly in a washing machine. By laundry product it is meant a detergent or fabric conditioning composition.

Preferably a laundry product is poured into a washing machine drawer or a dosing ball, and then the ancillary laundry composition is poured on top of the laundry product in the drawer or dosing ball.

Pouring the ancillary laundry composition on top of the laundry product provides the benefit that the laundry liquid carries the serum into the wash or rinse without mixing with the two compositions.

Alternatively, the ancillary laundry composition may be added to the wash separately to any other laundry products being used in the wash process. e.g. at a different stage, in a separate compartment of a washing machine drawer, in a separate dosing ball etc.

Preferably the ancillary laundry composition is added to the laundry process in a volume of 2-50 ml, more preferably a volume of ml 2-30 ml, most preferably 2-20 ml.

Use of the Composition

The ancillary laundry composition of the present invention may be used for softening knitted cotton. One method of measuring softening is by measuring friction of the treated fabrics. Softening may be described as fabric care or fibre care.

EXAMPLES

Example Formulations:

Detergent Composition:

The detergent composition used in the examples was a 2:1:3 surfactant mixture of Linear alkybenzene sulphonate (LAS): sodium lauryl ether (3) sulphate (SLES): Linear alcohol (C12-15) ethoxylate (7), which was neutralised to pH 7.5.

TABLE 1

Serum Compositions:

| | | Serum Composition | |
|---|---|---|---|
| | | A | 1 |
| Base serum | Silicone[1] | 5 wt. % | 5 wt. % |
| | Cationic polymer[2] | 2 wt. % | 2 wt. % |
| | Water | To 100% | To 100% |
| Added to base serum | Soil release polymer[3] | — | At a ratio of 10:1 base serum:soil release polymer |

Silicone[1]-Silicone added as a 30% silicone emulsion. The silicone comprised a carboxy group in a mid-chain pendent position ex. Wacker.
Cationic polyme[r2]-Ucares Polymer LR400 ex. Dow. This is a Polyquaternium-10 polymer
Soil release polymer[3]-TexCare SRN 170 ex. Clarient. This is a non-ionic soil release polymer.

Experimental Procedure:

Three fabric conditions were tested:

Detergent only

Detergent and Serum A

Detergent and Serum 1

Sample fabrics were washed three times using a Tergotometer pot. For each wash, the following protocol was used:

Into the Tergotometer pot was placed 24 g of knitted cotton and 24 g of ballast fabric. 1200 g of water containing 500 ppm of the detergent composition was poured onto the fabric, in the Tergotometer pot. 1.2 g of the serum composition was then poured into the pot (except for the serum free condition). The pots were heated to 30° C. and washed for 45 minutes at a paddle speed of 100 rpm. The fabrics were rinsed twice in the tergo pot for 5 minutes. Fabrics were squeezed by hand in between the wash and rinses to remove excess water. After the first two washes, the fabrics were spun for 30 seconds and the tumble dried on 'extra dry' setting. After the third wash, the fabrics were spun for 30 seconds and line dried in a room overnight.

Smoothness and Softness were measured using a PhabrOmeter® ex. Nu Cyberteck Inc.

Results:

TABLE 2

| Results | | |
|---|---|---|
| | Mean Softness | Mean Smoothness |
| Detergent only | 84.77488 | 54.05241 |
| Detergent and Serum A | 85.39936 | 55.47278 |
| Detergent and Serum 1 | 86.59858 | 57.42075 |

A higher number equates to better softening and smoothness. The fabric treated with a serum comprising silicone and soil release polymer showed the best softening and smoothness effect on knitted cotton.

The invention claimed is:

1. A method for softening knitted cotton, wherein knitted cotton is treated with an ancillary laundry composition comprising:

soil release polymer, wherein the soil release polymer is present in an amount of 1 to 30 wt % of the laundry composition;

silicone, wherein the silicone is present in an amount of 1 to 60 wt % of the laundry composition and soil release polymer to silicone is at a weight ratio of 10:1 to 1:10;

less than 4 wt % surfactant; and water;

wherein the method comprises delivering the ancillary laundry composition into the wash or rinse stage and comprises:

pouring a laundry product into a washing receptacle, a washing machine drawer, or a dosing shuttle; and pouring the ancillary laundry composition on top of the laundry product such that the laundry product and the ancillary laundry composition are used concurrently.

2. The method according to claim 1, wherein the soil release polymer is selected from polymers according to the formula:

X1-R1-Z—R2-X2 wherein:

X1 and X2 are each independently capping moieties;

R2 and R1 are each independently one or more nonionic hydrophilic blocks; and

Z is one or more anionic hydrophobic blocks.

3. The method according to claim 1, wherein silicone is in a form of an emulsion.

4. The method according to claim 1, wherein silicone is selected from anionic functionalized silicone, non-functionalized silicone or a mixture thereof.

5. The method according to claim 1, wherein the ancillary laundry composition is used in addition to a laundry detergent, a fabric conditioner composition or both.

6. The method according to claim 1, wherein the ancillary laundry composition further comprises a perfume.

7. The method according to claim 1, wherein the ancillary laundry composition is dosed in a volume of 2 to 50 ml.

8. The method according to claim 1, wherein the composition further comprises a cationic polymer.

9. The method according to claim 1, wherein the laundry product is poured into a washing machine drawer, and the ancillary laundry composition is poured on top of the laundry product in the drawer.

10. The method according to claim 1 wherein softened knitted cotton is recovered.

* * * * *